United States Patent [19]

Gilbert et al.

[11] 4,113,984

[45] Sep. 12, 1978

[54] VOLTAGE TRANSLATING CIRCUIT FOR VOLUME AND BALANCE CONTROL OF A FOUR-CHANNEL AUDIO SYSTEM

[75] Inventors: William F. Gilbert; Larry D. Lucas, both of Kokomo, Ind.

[73] Assignee: General Motors Corporation, Detroit, Mich.

[21] Appl. No.: 741,805

[22] Filed: Nov. 15, 1976

Related U.S. Application Data

[63] Continuation-in-part of Ser. No. 724,747, Sep. 17, 1976, abandoned.

[51] Int. Cl.[2] ..... H04R 5/00

[52] U.S. Cl. ..... 179/1 GQ; 179/1 VL

[58] Field of Search ..... 179/1 GQ, 1 VL, 1 G, 179/100.1 TD, 15 BT, 100.4 ST

[56] References Cited

U.S. PATENT DOCUMENTS

| | | | |
|---|---|---|---|
| 3,702,901 | 11/1972 | Cherry | 179/1 VL |
| 3,725,583 | 4/1973 | Gunderson et al. | 179/1 VL |
| 3,769,459 | 10/1973 | Niffenegger et al. | 179/1 VL |
| 3,875,334 | 6/1973 | Hilbert et al. | 179/1 D |
| 3,937,885 | 2/1976 | Gay | 179/1 VL |

*Primary Examiner*—Douglas W. Olms
*Attorney, Agent, or Firm*—Albert F. Duke

[57] ABSTRACT

Audio control circuitry for a four-channel system is disclosed which permits volume adjustment from a single master volume control potentiometer and balance adjustment from a single left-right balance potentiometer and a single front-rear balance control potentiometer.

5 Claims, 4 Drawing Figures

VOLTAGE TRANSLATING CIRCUIT FOR VOLUME AND BALANCE CONTROL OF A FOUR-CHANNEL AUDIO SYSTEM

This is a Continuation-In-Part of Ser. No. 724,747, filed Sept. 17, 1976 now abandoned, for "A Voltage Translating Circuit For Volume And Balance Control Of A Four-Channel Audio System."

This invention relates to audio control circuitry and more particularly to circuitry for electronically controlling audio functions such as tone, volume and balance in a multi-channel receiver.

It has been proposed in the prior art to provide a variable DC voltage for electronically controlling tone, volume and balance of the audio output of a receiver. There are a number of advantages of such electronic control of audio functions. For example, a single potentiometer can be used to generate the DC voltage which can then control a plurality of channels thus eliminating the problems associated with the former requirements of matching potentiometers in such multi-channel applications. Furthermore, greater flexibility in circuit layout is achieved due to the fact that audio signals need not be channeled to the front of the receiver in order to connect the controls. Indeed the controls may be remotely located from the receiver giving greater design freedom in automobile applications.

In co-pending application, Ser. No. 730,950, filed Oct. 8, 1976 now U.S. Pat. No. 4,076,959 and assignee of the present invention, an audio processing and control circuit for controlling tone and volume from individual potentiometers is disclosed. The circuit also includes balance control circuitry responsive to the position of a balance potentiometer for controlling left to right balance. One of the advantages of the volume control circuitry of the aforementioned application is the linear change in attenuation as measured in dB in response to linear movement of the volume control potentiometer. This eliminates the necessity of utilizing a potentiometer specifically designed to produce a linear attenuation, i.e. a logarithmic potentiometer.

In accordance with the present invention, two of the integrated circuits of the aforementioned application are employed to provide a four-channel audio system. By wiring the balance control inputs together, a single linear potentiometer can simultaneously control the left to right balance in the two front channels and in the two rear channels. Front-to-rear balance is achieved by controlling the volume inputs to the two integrated circuits of the aforementioned application. In accordance with the present invention, control circuitry is provided which is responsive to a DC control voltage from a master volume control potentiometer and from a front-rear balance potentiometer for generating the necessary two volume control voltages which are applied to the integrated circuits to provide a front-to-rear balance control for the four-channel system. The output level of all four channels at balance and of the favored two channels when out of balance is set by the master volume control potentiometer. Thus, if a balance condition does not exist, the favored two channels remain at the level determined by the master volume potentiometer and the remaining two channels are attenuated from the reference level determined by the master volume potentiometer by an amount proportional to the deviation of the front-rear potentiometer from a balance condition.

A more complete understanding of the present invention may be had from the following detailed description which should be read in conjunction with the drawings in which.

Figure 1:
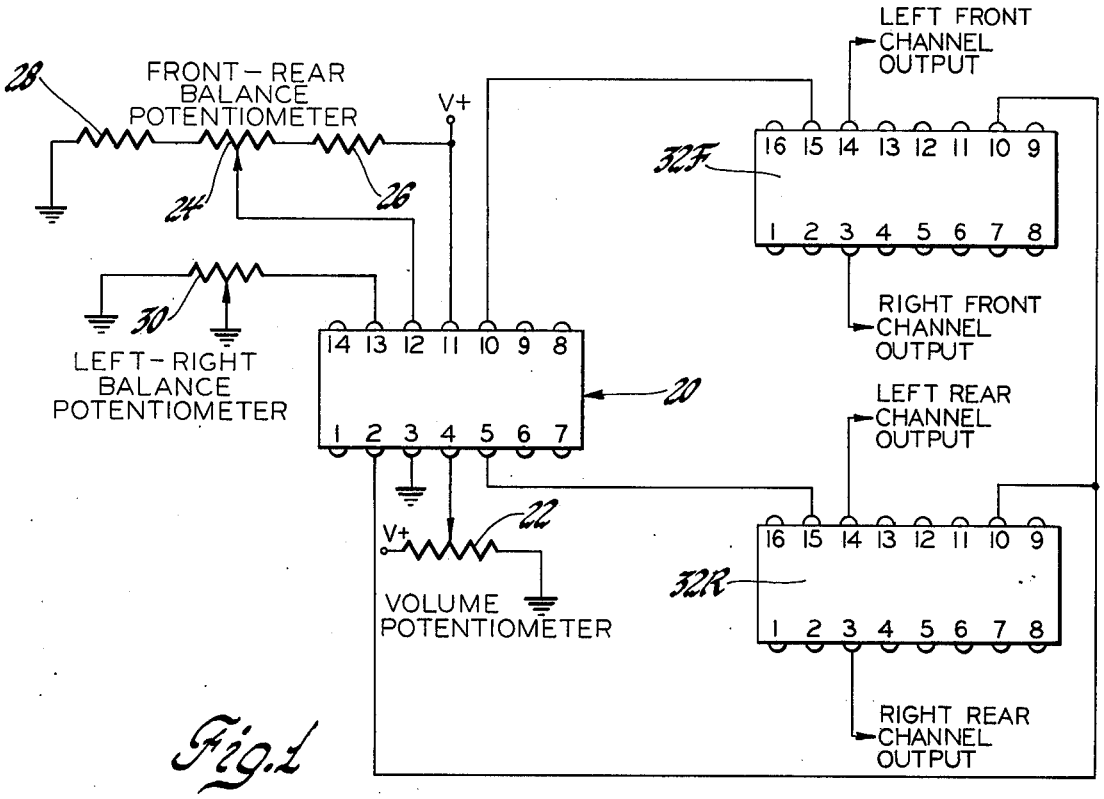
FIG. 1 is a block diagram of the system of the present invention.

Referring now to the drawings and initially to FIG. 1, the integrated circuit of the present invention is generally designated 20. An 8 volt regulated supply V+ is connected with pin 11 of the circuit 20. A volume control potentiometer 22 is connected between V+ and ground with its wiper connected with pin 4 of the circuit 20. A front-rear balance potentiometer 24 is connected to V+ through a resistor 26 and to ground through a resistor 28. The wiper of the potentiometer 24 is connected with pin 12 of the circuit 20. A left-right balance potentiometer 30 is connected with pin 13 of the circuit 20 and to ground and has a grounded wiper. Output pin 2 of the circuit 20 provides a DC control voltage to pin 10 of integrated circuits 32F and 32R. The output voltages on pins 10 and 5 of the circuit 20 are applied to pin 15 of each of the circuits 32F and 32R. The circuits 32F and 32R are identical and include tone, volume and balance control circuitry for the left and right channels of a stereo audio system. The details of the circuit 32F may be found in the aforementioned patent application which is incorporated herein by reference. The left and right channel outputs of the circuits 32F and 32R are taken from pins 14 and 3 respectively. The left-right balance potentiometer 30 controls the DC voltage applied from the output pin 2 of circuit 20 to the input pin 10 of the circuits 32F and 32R to control the left-right balance of the front and rear channels of the four channel system. The volume potentiometer 22 controls the upper limits of the voltage outputs of the pin 10 and 5 of the circuit 20 while the front-rear balance potentiometer 24 controls the relative levels of the voltages at pins 10 and 5 of the circuit 20 by lowering one relative to the other.

Figure 2:
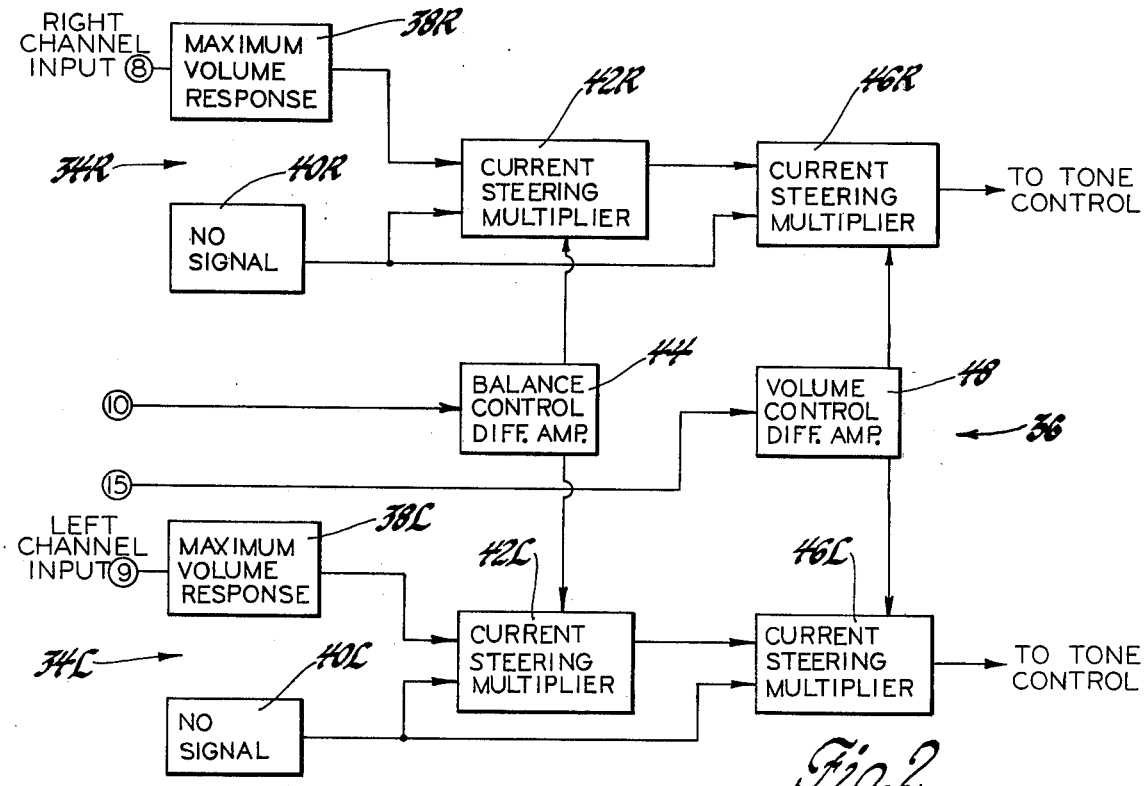
FIG. 2 is a more detailed block diagram of a portion of the system shown in FIG. 1.

Referring now to FIG. 2, a portion of the circuit 32F is shown. The circuit 32F includes left and right processing channels 34R and 34L and control circuitry 36. The right audio input from the stereo decoder is fed to a balance and volume section of the circuit 32F which includes circuitry 38R which converts the input voltage signal at pin 8 to a modulated DC current which is the maximum signal that can appear at the pin 3 output of the circuit 32F. An unmodulated DC current (no signal current) is produced in bias circuitry generally designated 40R and represents the minimum volume signal current. A current steering multiplier 42R provides an output current consisting of complementary percentages of the two input currents such that the DC level of the output current is always the same. The output of the multiplier 42R can vary from the full input signal current from circuitry 38R corresponding to maximum volume on the right channel to all of the unmodulated current input from the circuitry 40R corresponding to minimum volume. The corresponding components 38L–42L in the left channel 34L perform the same function in the left channel signal flow. The current steering multipliers 42R and 42L are controlled from a balance control circuit 44 which in turn is responsive to the DC control voltage at pin 10. The circuitry 44 includes two differential amplifiers, one to control each of the multipliers 42R and 42L. When the DC voltage at pin 10 is at mid-range, the differential amplifiers in the circuit 44 cause the multipliers 42R and 42L to be in the maximum volume condition. As the control voltage is increased from the mid-range position, the multiplier 42R remains in a position passing the maximum volumn input current, and the multiplier 42L begins to attenuate the left channel signal. As the DC control voltage at pin 10 is reduced from the mid-range position, the multiplier 42L causes the left channel signal to remain at maximum signal level, and the multiplier 42R begins to attenuate the right channel signal. The output of the multiplier 42R is fed to a multiplier 46R which receives a second input from the circuitry 40R. The output of the multiplier 46R is a summation of complementary percentages of the two input currents such that the output can vary from all of the input current from the multiplier 42R which represents maximum volume to all of the unmodulated DC input current from the circuit 40R which represents minimum volume. The multipliers 46R and 46L are controlled from a dual differential amplifier 48 which in turn is responsive to the DC control voltage at pin 15. The dual differential amplifier 48 controls the multipliers 46R and 46L so that a linear relationship is established between signal attenuation as measured in dB and change in the DC voltage at pin 15.

Figure 3:
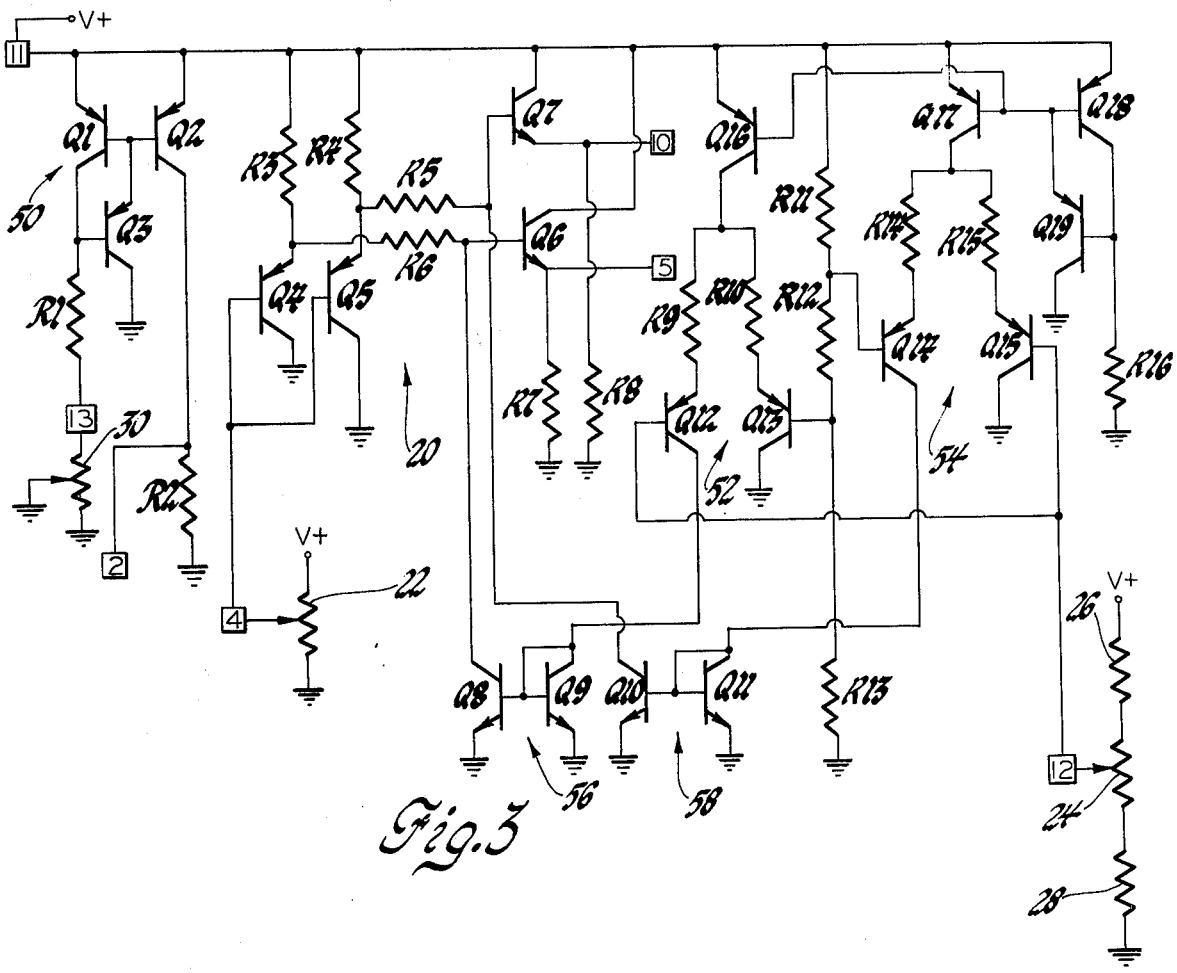
FIG. 3 is a detailed schematic diagram of the voltage translating circuit of FIG. 1.

Referring now to FIG. 3, the circuitry 20 is shown in detail. The left-right balance potentiometer 30 is connected to a current mirror generally designated 50 and comprising transistors Q1, Q2 and Q3 through a resistor R1. The current mirror 50 allows the left-right balance control on the circuits 32F and 32R to be controlled from a potentiometer having a grounded wiper. The DC control voltage to be applied to pin 10 of the circuits 32F and 32R is developed across load resistor R2 connected with the transistor Q2. The values of the resistors R1 and R2 are determined by the desired output voltage range, the resistance of the grounded-wiper potentiometer chosen and the current level at which the mirror circuit operates best. The potentiometer 30 is tapered to produce a balance control voltage which varies linearly with potentiometer movement and which cancels the non-linear effects of the fixed resistance R1 in series with the potentiometer 30.

The voltage on the wiper of the master volume control potentiometer 22 is applied to the bases of transistors Q4 and Q5. If 0 volts, corresponding to minimum volume, is applied to the base of transistors Q4 and Q5, their emitters will be one base-emitter voltage higher. Current flow through the resistors R3 and R4 is such that all of the supply voltage, except the base-emitter voltage drop, is developed across these resistors. A small amount of current flows through resistors R5 and R6 to the bases of output transistors Q6 and Q7. The base current through transistors Q6 and Q7 cause a normal base-emitter voltage to be established. Thus, the master volume control voltage established by the potentiometer 22 is translated upward one base-emitter voltage by transistors Q4 and Q5 and translated back down one base-emitter voltage by transistors Q6 and Q7. The net effect is to convert a single master volume control voltage into two control voltages which are identical therewith. The voltages are applied to the pin 15 volume control inputs of the circuits 32F and 32R. Consequently when the front-to-rear potentiometer 24 is set to produce balance, the two front channels controlled by the circuit 32F produce an output level determined by the master volume control 22 and the two rear channels controlled by the circuit 32R produce identical output levels. If the potentiometer 22 is set at 0 volts all four channels would produce a minimum output level. As the voltage supplied to the bases of transistors Q4 and Q5 rises, the transistors Q4 and Q5 cause less current to flow through resistors R3 and R4. The emitters of transistors Q4 and Q5 remain one base-emitter voltage above the base voltages until the emitter voltages equal the supply voltage. The difference between the supply voltage and the emitter voltage of the transistors Q4 and Q5, if any, is developed across resistors R3 and R4. As the voltages on the emitters of transistors Q4 and Q5 rise, progressively larger currents flow through resistors R5 and R6 to the bases of transistors Q6 and Q7. This causes transistors Q6 and Q7 to supply current to resistors R7 and R8. Thus, at balance the voltages across resistors R7 and R8 duplicate the master volume control voltage as long as the master volume voltage is between ground and one base-emitter voltage below the supply voltage. The circuits 32F and 32R compensate for the inability of the volume control output voltages of the circuit 20 to reach the supply voltage by producing maximum volume at the output when the control voltage on pin 15 is within one base-emitter voltage of the supply voltage.

The front-rear balance control voltage at pin 12 of the circuit 20 is applied to the bases of transistors Q12 and Q15 of differential amplifiers 52 and 54. The control voltage is generated by the potentiometer 24 which has its wiper connected to pin 12 of the circuit 20. The potentiometer 24 is the center element of the voltage divider network including the resistors 26 and 28. The control voltage appearing at the wiper of potentiometer 24 can vary from 1.5 volts to 6.5 volts if an 8 volt supply is used. The differential amplifiers 52 and 54 are supplied with current by constant current sources comprising transistors Q16, Q17, Q18 and Q19. The magnitude of the constant current is established by the resistor R16. The transistors Q16 and Q17 are connected so that they mirror the current through Q18, and consequently a constant current is applied to each differential amplifier. A voltage divider network comprising resistors R11, R12 and R13 establish a voltage at the base of Q13 which is 2.46 volts and a voltage on the base of Q14 which is 5.54 volts.

Figure 4:
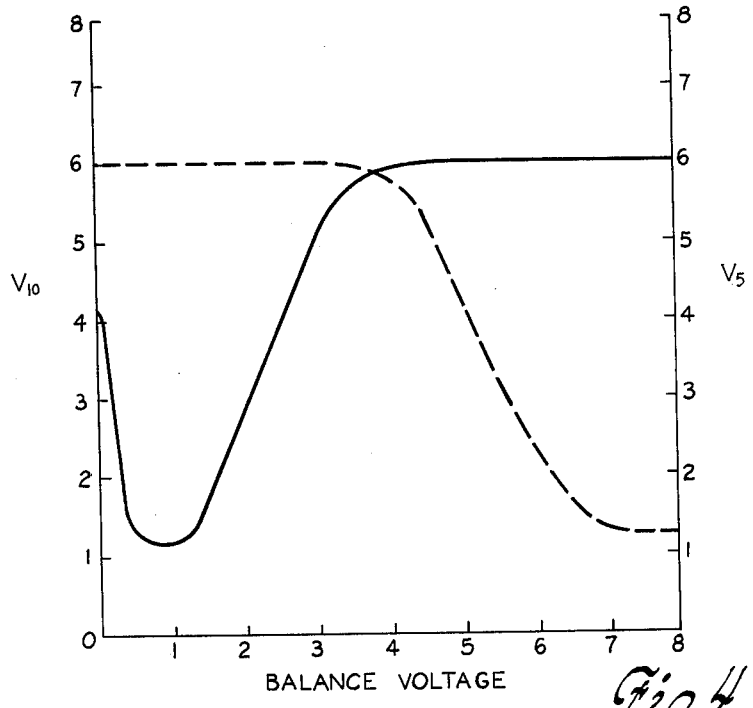
FIG. 4 is a transfer characteristic for the circuit of FIG. 3.

The resistor R12 produces a voltage offset between the base of Q13 and Q14 of slightly over 3.0 volts. The resistors R11 and R13 are the same value so that the voltage at balance is centered at half the supply voltage. The emitter degeneration resistors R9, R10, R14 and R15 allow the transfer characteristic to be flattened as shown in FIG. 4. The value chosen for these resistors spreads the useable portion of the transfer characteristic over a range of balance control input voltages extending from 1.0 volt to 7.0 volts. The allowed range for the balance control voltage is restricted to 1.5 volts to 6.5 volts by the resistors 26 and 28 in series with the potentiometer 24. This restriction in the range of the balance control voltage prevents operation of the circuit at low balance control voltages where an undesirable reversal occurs in the transfer characteristic as shown in FIG. 4.

In the balanced condition, 4.0 volts is applied to the base of Q12 and Q15. Since the base of Q13 is at 2.46 volts essentially all of the current supplied by Q16 flows through Q13 and essentially no current flows through Q12. A current mirror 56 comprising transistors Q8 and Q9 is connected between the collector of Q12 and the junction between the resistor R6 and the base of Q6. Since no current flows through Q12 at balance, no current flows in the collector of Q8 and the voltage at the emitter of Q6 is equal to the master volume control voltage established by the potentiometer 22 as described above. In like manner most of the current supplied by Q17 flows through Q15. Consequently, very little current flows through the current mirror 58 comprising transistors Q10 and Q11, and the voltage on the emitter on Q7 is the same as the master volume control voltage established by the potentiometer 22. If the balance control voltage at pin 12 is increased to 6.0 volts, the existing offset in the differential amplifier 52 is accentuated while the control voltage at the base of Q15 reverses the base offset condition in the differential amplifier 54. With the base of Q15 higher than the base of Q14 most of the current supplied by Q17 flows through Q14 and into the current mirror 58. Transistor Q10 now shunts current from the base of transistor Q7 lowering the base voltage of Q7 and the output voltage at pin 10. The voltage on the emitter of Q6 remains the same. If the voltage at pin 12 is now lowered below the voltage at the base of Q13, current supplied by the transistor Q16 will be diverted through the transistor Q12 to the current mirror 56 causing the voltage at the base of transistor Q6 to drop and the voltage at pin 5 to drop. As the voltage on pin 12 is lowered, the existing offset in the differential amplifier 54 is accentuated so that the voltage on pin 10 is determined by the voltage established by the volume potentiometer 22 independently of the voltage established by the front-rear balance potentiometer 24. The change in output voltage at pins 5 and 10 in response to various settings of the potentiometer 24 is shown in FIG. 4. An upper limit of 6.0 volts is established by the potentiometer 22.

Having thus described our invention what we claim is:

1. A balance control for a four channel audio system providing front left and right audio output signals and rear left and right audio output signals in response to respective audio input signals, said control comprising, first circuit means responsive to a first DC control voltage for attenuating said front left and right audio input signals, second circuit means responsive to a second DC voltage for attenuating said rear left and right audio input signals, a master volume control potentiometer means, a front-rear balance control potentiometer means, a voltage translating circuit responsive to the setting of said volume control potentiometer means and said balance control potentiometer means for developing said first and second DC control voltages, the upper limit of said first and second control voltages being established by the setting of said volume control potentiometer means, said front-rear balance potentiometer means reducing the magnitude of one of said first or second DC control voltages from said upper limit to a lower limit as said front-rear potentiometer means is moved from a balance position to one extreme unbalanced position respectively while maintaining the magnitude of the other of said first or second DC controlled voltages, said first circuit means responsive to a third DC control voltage for controlling the balance between said front left and right audio output signals by attenuating one of the front left or front right audio input signals relative to the other, said second circuit means responsive to said third DC control voltage for controlling the balance between the rear left and right audio output signals by attenuating one of the rear left or rear right audio input signals relative to the other, a single left-right balance potentiometer means for providing said third DC voltage.

2. In a four channel audio system including front left and right channels and rear left and right channels and including means for developing front left and right and rear left and right audio signals, the improvement comprising balance control circuitry including first circuit means for controlling the amplitude of said front left and right audio signals in response to a first DC control voltage, second circuit means for controlling the amplitude of said rear left and right audio signals in response to a second DC control voltage, a volume control potentiometer for developing a first DC bias voltage, a balance control potentiometer for developing a second DC bias voltage, a voltage translating circuit responsive to said first and second DC bias voltages for developing said first and second DC control voltages, said voltage translating circuit comprising third and fourth circuit means each connected with said volume control potentiometer for developing said first and second DC control voltages, the upper limit of said first and second DC control voltages being established by said volume control potentiometer, first and second current generating means connected with said balance control potentiometer and responsive to said second bias voltage, one of said current generating means providing an output current which varies between a minimum and a maximum while the output current of the other current generating means remains at a mininum as said balance potentiometer is moved from a balanced position to one extreme unbalanced position; said other current generating means providing an output current which varies between a minimum and a maximum while the output current of said one current generating means remains at a minimum as said balance potentiometer is moved from a balanced position to the other extreme unbalanced position, said third and fourth circuit means responsive to said first and second output currents to reduce one of said first and second output voltages while maintaining the other at said upper limit as said balance potentiometer is moved away from said balanced position.

3. The balance control circuit of claim 2 further comprising a single left-right balance potentiometer including resistor means having one side grounded and further including a grounded wiper, a current mirror comprising first and second transistors interconnected with said source of DC voltage such that the collector current of the second transistor is dependent on the current drawn by the first transistor, second resistor means connecting said first transistor to the other side of said potentiometer resistor means, said first and second circuit means further including means responsive to a third DC control voltage for attenuating one of the front left or front right audio signals relative to the other and for attenuating one of the rear left or rear right audio signals relative to the other, a load resistor connected with the collector of said second transistor for developing said third DC control voltage and means connecting said load resistor to said first and second circuit means.

4. A voltage translating circuit comprising a volume control potentiometer for developing a first DC input voltage, a balance control potentiometer for developing a second DC input voltage, first and second output transistors connected with first and second load resistors for establishing first and second output voltages, first and second voltage divider means connected with the base electrodes of said first and second output transistors respectively, first and second buffer transistors connecting said volume control potentiometer with a junction in each of said first and second voltage divider means for establishing a voltage at the base of said first and second output transistors proportional to said first DC input voltage and representing an upper bias voltage limit, first and second differential amplifier means, means supplying a substantially constant current to said first and second differential amplifier means, means connecting said second DC control voltage to each of said first and second differential amplifiers, voltage divider means for establishing first and second reference voltages for said first and second differential amplifiers, said first and second reference voltages differing by a predetermined offset amount whereby the output current of one differential amplifier varies between a minimum and a maximum while the output current of the other differential amplifier remains at a minimum as said balance potentiometer is moved from a balanced position to one extreme unbalanced position; and the output current of said other differential amplifier varies between a minimum and a maximum while the output current of said one differential amplifier remains at a minimum as said balance potentiometer is moved from a balanced position to the other extreme unbalanced position, first and second transistor means coupled to the output of said first and second differential amplifiers respectively and to said first and second voltage divider means respectively for lowering the voltage at the base electrodes of one of said first or second output transistors as said balance potentiometer is moved from a balanced position to an unbalanced position, whereby the maximum level of either of said first and second output voltages is dependent on the position of said volume potentiometer and the relative levels of said first and second output voltages are dependent on the position of said balance potentiometer.

5. A balance control for a four channel audio system including means providing front left and right audio output signals and rear left and right audio output signals in response to respective audio input signals said control comprising, first circuit means for controlling the balance between said front left and right audio output signals and responsive to a DC control voltage for attenuating one of the front left or front right audio input signals relative to the other, second circuit means for controlling the balance between the rear left and right audio output signals and responsive to said DC control voltage for attenuating one of the rear left or rear right audio input signals relative to the other, a single left-right balance potentiometer means including first resistor means having one side grounded and further including a grounded wiper, transistor means adapted to be connected with a source of DC voltage for developing an output current proportional to the position of said potentiometer means, second resistor means connecting said transistor means to the other side of said potentiometer means, a load resistor connected with said transistor means for developing said DC control voltage as a function of said output current and means connecting said load resistor to said first and second circuit means.

* * * * *